United States Patent [19]

Dupont et al.

[11] Patent Number: 4,497,858

[45] Date of Patent: Feb. 5, 1985

[54] TILE FOR AN ENTRANCE MAT

[76] Inventors: André Dupont, 409 Marquette St., Longueuil, Canada, J4K 4G8; Paul Laurent, 841 Hélène Boulé St., Boucherville, Canada, J4B 5V6

[21] Appl. No.: 530,760

[22] Filed: Sep. 9, 1983

[51] Int. Cl.[3] ..... B32B 3/10

[52] U.S. Cl. ..... 428/44; 52/588; 52/591; 52/594; 404/41; 428/60; 428/169

[58] Field of Search ..... 428/33, 44, 45, 49, 428/53, 55, 169, 60; 15/215, 238; 52/15, 588, 591, 594, 302; 404/39, 41, 42

[56] References Cited

U.S. PATENT DOCUMENTS

| | | | |
|---|---|---|---|
| 3,802,144 | 4/1974 | Spica | 428/53 |
| 4,018,025 | 4/1977 | Collette | 52/590 |
| 4,287,693 | 9/1981 | Collette | 428/134 |
| 4,468,910 | 3/1983 | Morrison | 428/45 |

*Primary Examiner*—George F. Lesmes
*Assistant Examiner*—William M. Atkinson

[57] ABSTRACT

A tile for use in constructing an entrance mat. The tile has a flat base and low walls surrounding the base for retaining water on the base. Scraper means are provided on the base for scraping snow, water and/or slush off the feet of people using the mat. Means are provided on each wall for use in connecting the tile to an adjacent tile. A plurality of the tiles are connected together to form a mat. Means are provided in each wall of a tile for directing water out of the tile when it reaches a certain level. The invention is also directed toward a mat made up of a plurality of the tiles.

10 Claims, 5 Drawing Figures

TILE FOR AN ENTRANCE MAT

FIELD OF THE INVENTION

This invention is directed toward a tile for use in constructing an entrance mat, and to an entrance mat made from a number of the tiles.

DESCRIPTION OF THE PRIOR ART

Entrance mats in the entrances of busy places such as stores and hotels are at present made in one piece. The mats are made in various sizes in order to fit different locations. However it is costly to provide a stock of different sized mats. The known mats are also usually made from thickly woven or knitted material and the snow and/or water tracked onto the mat usually accumulates in the most heavily used portion of the mat until the water runs off that portion of the mat onto the floor adjacent the mat. The water on the floor is then tracked into the building from the entranceway, thus considerably reducing if not negating the effectiveness of the mat.

DISCLOSURE OF THE INVENTION

It is the purpose of the present invention to provide a tile, a plurality of which can be connected together to form a mat of desired size. Thus only one size of tile need be manufactured and maintained in stock. Various sizes of entrance mats can be constructed from the tiles, using only that number of tiles needed to make each desired size of mat. It is understood that each mat size is a multiple of the tile size.

It is another purpose of the present invention to provide a tile which can retain a relatively large amount of water thereby providing a mat, made from the tiles, which can also retain a relatively large amount of water. More importantly, it is a purpose of the present invention to provide a mat, made from tiles, in which water can be distributed over the surface of the mat. Thus, as water accumulates in the tiles of the most used portion of the mat, means in the tiles allow the water to be distributed to less used portions of the mat before it is allowed to spill off the mat. Thus the mat can hold more water before overflow occurs.

In accordance with the present invention, a tile of quadrangular shape is provided, which has a base and low walls surrounding the base to hold water on the base. Scraping means, such as ribs, are provided on the base within the walls, projecting up from the base so that snow and/or water and/or slush can be scraped off the feet of people walking on a mat made up of the tiles. Connecting means are provided on the walls of the tile for use in connecting the tile to adjacent tiles in order to form a mat. The connecting means preferably comprise female connecting means on two adjacent walls of the tile, and male connecting means on the other adjacent walls of the tile.

Also in accordance with the present invention, each tile is provided with water directing means for directing water between the tile and one or more adjacent tiles so as to more uniformly distribute water over the surface of a mat made up from the tiles. The water directing means preferably comprises one or more shallow channels formed in the top of each wall of a tile. When the water level in a tile reaches the height of the channels in its walls, the water flows out of the tile through the channels into adjacent tiles. In this manner water accumulated in the mat is generally evenly distributed over the mat before overflow occurs.

Means may be provided about the periphery of the mat for providing a smooth edge about the mat and for retaining water on the mat by blocking those channels in the walls of the tiles forming the outer edge of the mat. These edging means comprise edging strips, each having a smooth outer side and connecting means on its inner side cooperating with the connecting means of the tiles on each edge of the mat. These edging means preferably straddle adjacent tiles to reinforce the connecting means between adjacent marginal tiles.

The tiles are molded in one piece from rubber-like plastic material, such as P.V.C., so they are flexible and watertight.

The invention is particularly directed toward a tile for use in constructing a mat, the tile having a flat base with a quadrangular shape. The tile is of a shape that allows a plurality of same to be connected together to form a mat. A low wall is provided along the perimeter of the base, to hold water on the base. Scraper means are provided on the base within the walls. There are also preferably provided channels in the scraper means to allow excess water to flow off the scraper means. Means are provided on the outer surface of each wall for use in connecting the tile adjacent tiles.

The tile of the present invention also includes means in each wall for use in directing water out of the tile when it reaches a certain level on the base.

The invention is also particularly directed toward a mat made from a plurality of such tiles connected to each other by appropriate connection means.

BRIEF DESCRIPTION OF THE DRAWINGS

The invention will now be described in detail having reference to the accompanying drawings in which.

DESCRIPTION OF A PREFERRED EMBODIMENT

Figure 1:
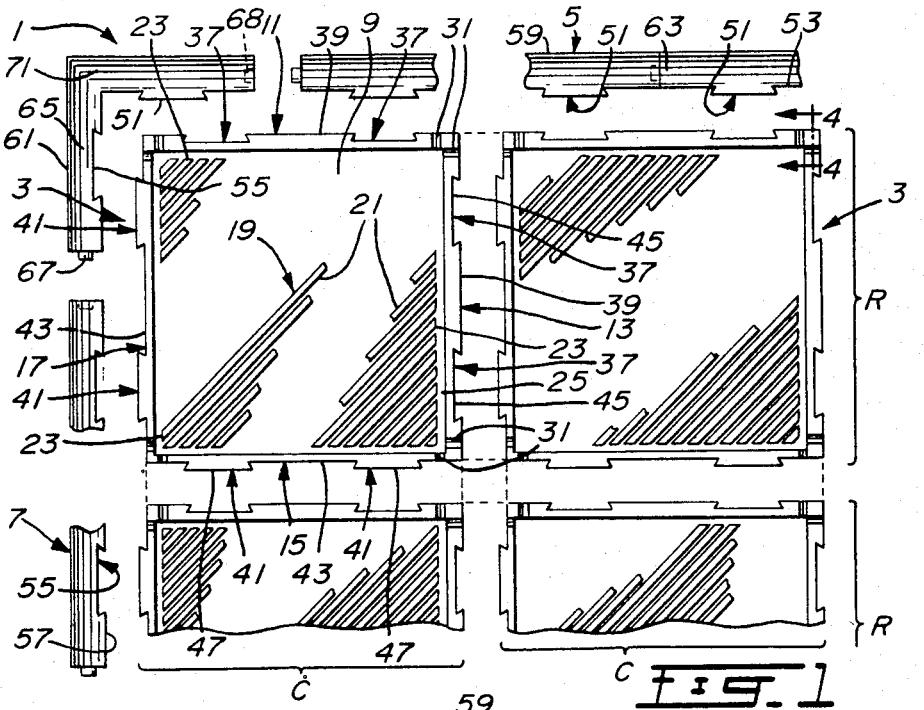
FIG. 1 is an exploded, detail view of one corner of an entrance mat incorporating the tiles of the present invention.
Figure 2:
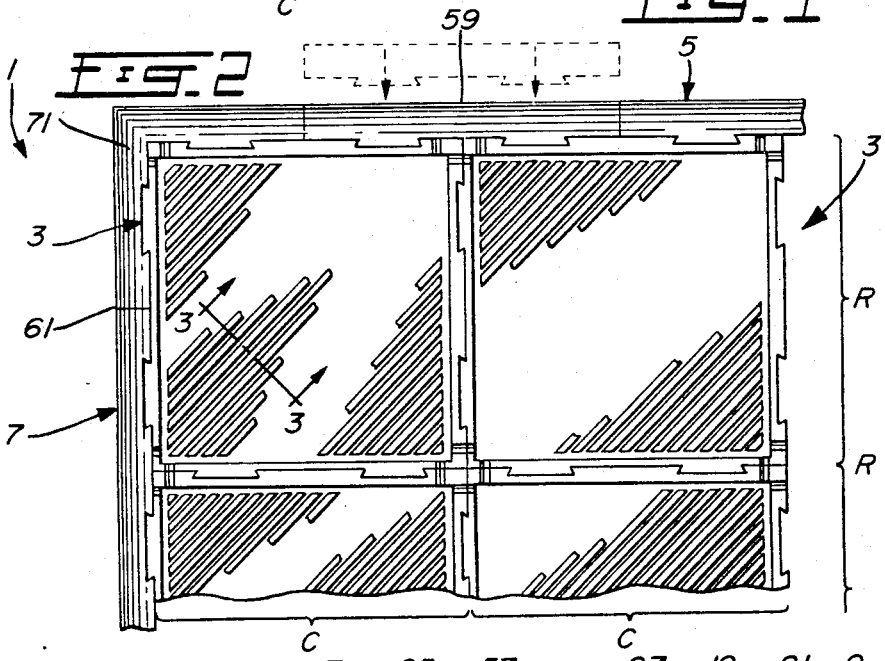
FIG. 2 is a detail view of one corner of an entrance mat.

The entrance mat 1 of the present invention, as shown in FIGS. 1 and 2, comprises a plurality of interlocked tiles 3 surrounded by edging strips 5, 7. The tiles 3 are arranged in rows "R" and columns "C" with the same number of tiles in each row, and the same number of tiles in each column. The number of tiles in each row "R" can differ from the number of tiles in each column "C".

Figures 3, 4, 5:
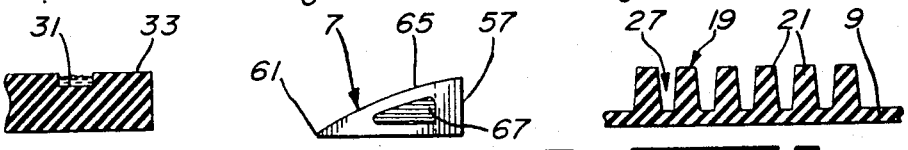
FIG. 3 is a cross-section view taken along line 3—3 in FIG. 1.
FIG. 4 is a cross-section view taken along line 4—4 in FIG. 1.
FIG. 5 is an end view of an edging strap in FIG. 2.

The tiles 3 are identical and each has a quadrangular, preferably square, shape. Each tile 3 has a flat base 9 surrounded on its four sides by short walls 11, 13, 15, 17. The walls 11, 13, 15, 17 are joined together and serve to hold water or other liquid, on the base 9. Scraper means 19 are provided on the base within the walls 11 to 17 for scraping snow, and/or water, and/or slush, off shoes or boots. The scraper means 19 preferably comprise a plurality of spaced-apart ribs 21, as shown in FIG. 3 integral with the base 9 and projecting up therefrom. The ribs 21 preferably have the same height as the walls 11 to 17 and extend diagonally across the base 9. The ribs 21 are spaced close enough together so that spike heels cannot be caught between the ribs. The ends 23 of each rib 21 terminate just short of the walls 11, 13, 15, 17 providing a continuous outer channel 25 between the ribs 21 and the walls 11, 13, 15, 17. The channels 27 between the ribs 21 communicate with the outer channel 25.

Means are provided in each wall 11, 13, 15, 17 of the tile 3 for directing water in or out of the tile. These water directing means, as shown in FIG. 4, preferably comprise at least one slot or channel 31 in each wall extending down a short distance from its upper surface 33. Preferably, at least two channels 31 are provided in each wall, near each end of the wall.

Means are provided on each tile 3 for use in attaching it to adjacent tiles or to edging strips 5, 7. Female connecting means 37 are provided on the outer surface 39 of two adjacent walls 11, 13. Male connecting means 41 are provided on the outer surface 43 of the other two adjacent walls 15, 17. The female connecting means 37 preferably comprise a pair of shallow slots 45 in the outer surface 39 of each wall 11, 13, each slot having a base wider than its mouth. The male connecting means preferably comprise a pair of short projections 47 on the outer surface 43 of each wall 15, 17. Each projection 47 is located and sized to fit snugly into a slot 45 on an adjacent tile when two tiles are interlocked side-by-side.

Each tile 3 is flexible and is preferably molded in one piece from a rubber-like, plastic material, such as PVC polyurethane, for example. The tiles have a hardness, measured on the durometer scale, of seventy-five to eighty-five. Some abrasive material can be incorporated in the top surface of the tile when it is molded, if desired, to make it less slippery. slippery.

The tiles 3 are assembled into a mat 1 of desired size by connecting the required number of tiles together in rows and columns. The tiles in each row are connected together in the same manner. For example, each tile in a row can be arranged with one wall 11, with the female connecting means 37 therein, on "top" as when viewing FIGS. 1 and 2; and with the other adjacent wall 13, with the other female connecting means 37 therein, on the "right" when viewing FIGS. 1 and 2. Each tile will as a result have one wall 15, with the male connecting means 41 thereon, on the "bottom", as when viewing FIGS. 1 and 2, and the other adjacent wall 17, with the other male connecting means 41 therein, on the "left" as when viewing FIGS. 1 and 2. Thus, in each row "R", with the rows running across when viewing FIGS. 1 and 2, each tile has its male connecting means 41 in wall 17, mating with the female connecting means 37 in wall 13 on the adjacent tile to the left side.

In each column "C", with the columns running up-down when viewing FIGS. 1 and 2, each tile has its other male connecting means 41 in wall 15, mating with the other female connecting means 37 in wall 11 on the adjacent bottom tile.

The assembled mat 1 has a row of female connecting means 37 on two sides, the top and right sides, when viewing FIGS. 1 and 2; and a row of male connecting means 41 on its other two sides, the bottom and left sides, when viewing FIGS. 1 and 2. Edging strips 5, 7 are provided for the mat 1 about its outer edge. Each edging strip 5 on the top and right sides of the mat has male connecting means 51 on its inner side 53 cooperating with the female connecting means 37 on the top and right sides of the mat. Each edging strip 7 on the bottom and left sides of the mat has female connecting means 55 on its inner side 57 cooperating with the male connecting means 41 on the bottom and left side of the mat. The outer side 59, 61 of each edging strip 5, 7 respectively, is straight and its upper surface 63, 65 respectively, curves down from its inner side 53, 57 to its outer side 59, 61 respectively. This is shown in FIG. 5 for strip 7.

Edging strips 5 and 7 are of the same length as the side of a tile 3 and equally overlap two adjacent tiles to further reinforce the connecting means 41, 55 of marginal or border tiles. Each strip 5 and 7 is further provided with a stud 67 at one end and a mating cavity 69 at its other end to interconnect abutting strips 5 or 7. Right angular corner strips 71 are also provided with each leg half the length of a tile side and provided with male and female connecting means 51, 55 and a stud 67 and a cavity 69.

The assembled mat is placed adjacent an entrance and snow, water and/or slush is scraped off the feet of people walking over the mat by the scraper means 19. Any snow, water and/or slush scraped off falls between the scraper means 19 and melts. The water accumulates in each tile 3 on its base 9 within its walls 11, 13, 15, 17. If the water level in one tile becomes too high, the water is directed out of the tile into adjacent tiles by the aligned channels 31 at each corner. In this way the accumulated water spreads out over the mat while retained within the mat by the edging strips 5, 7.

The tiles 3 are interlocked tightly together so that water, flowing through the channels between tiles, will not readily flow down between the tiles. If any one tile is damaged it can be easily replaced.

What we claim is:

1. A tile having a flat imperforate base with a top surface and a shape defined by straight sides, said tile comprising low straight walls protruding from said top surface along each side of the base, said wall forming the entire perimeter of the base to hold water on the base, means for use in removably connecting the tile to adjacent identical tiles to form a mat with the outside surface of a straight wall of the tile abutting the outside surfaces of the straight walls of adjacent tiles, scraper members upstanding from and uniformly distributed over said top surface within the confines of said wall, the scraper members comprising a series of spaced-apart ribs extending across the base, the ends of each rib being spaced a short distance from the nearest wall, trough areas between and around said scraper members and between said scraper members and said walls to allow water to flow between said scraper members and reach said walls, and water-directing means formed through each straight wall, said water directing means being located between the corners defined by the junctions of successively adjacent straight walls, said water-directing means positioned for alignment with the water-directing means of adjacent connected tiles for directing water out of the tile to adjacent tiles when the water reaches a certain level on the top surface of the base.

2. A tile as claimed in claim 1 wherein the tile is square and flexible.

3. A tile as claimed in claim 1 wherein the ribs extend diagonally to the walls.

4. A tile as claimed in claim 1 wherein the water directing means comprises at least one channel in the top of each wall of the tile.

5. A tile as claimed in claim 4 wherein one channel is provided in the top of each wall near each end of the wall.

6. A tile as claimed in claim 1 wherein the means for use in connecting the tile to adjacent tiles comprises female connecting means on the outer surface of two adjacent walls of the tile and male connecting means on the outer surface of the other two adjacent walls of the tile.

7. A tile as claimed in claim 6 wherein the female connecting means on each wall comprises two spaced-apart, inwardly directed slots, and the male connecting means on each wall comprises two spaced-apart outwardly directed projections shaped and positioned to mate with the slots.

8. A mat made from a plurality of individual identical tiles, each tile in accordance with claims 1 or 7.

9. A mat as claimed in claim 8 wherein the means on each tile for use in connecting it to an adjacent tile comprises female connecting means on the outer surface of two adjacent walls of the tile, and male connecting means on the outer surface of the other two adjacent walls of the tile.

10. A mat as claimed in claim 8 including edging strips about the outer periphery of the mat for retaining water in the mat, each edging strip having means on its inner side for use in connecting each strip to the tiles defining the outer edge of the mat, and a smooth outer side.

* * * * *